US005442887A

United States Patent [19]

Welsh

[11] Patent Number: 5,442,887

[45] Date of Patent: Aug. 22, 1995

[54] SEAT AND ANCHOR ASSEMBLY FOR A ROOF TRUSS AND WOODEN JOIST

[76] Inventor: Holden A. Welsh, 6875 N. Cartee Rd., Miami, Fla. 33158

[21] Appl. No.: 149,612

[22] Filed: Nov. 9, 1993

[51] Int. Cl.[6] ..... E04B 1/38

[52] U.S. Cl. ..... 52/92.2; 52/93.2; 52/713

[58] Field of Search ..... 52/92.2, 92.1, 93.1, 52/93.2, 699, 713

[56] References Cited

U.S. PATENT DOCUMENTS

| | | | |
|---|---|---|---|
| 1,657,441 | 1/1928 | Huovines | 52/92.2 X |
| 2,947,119 | 8/1960 | Puckett, Jr. | 52/92.2 X |
| 3,000,145 | 9/1961 | Fine | 52/92.2 X |

*Primary Examiner*—Carl D. Friedman
*Assistant Examiner*—Robert J. Canfield
*Attorney, Agent, or Firm*—Malloy & Malloy

[57] ABSTRACT

A seat and anchor assembly for mounting and securing a wood joist or roof truss to a tie beam of a building including a channel length having a central web portion and two upwardly extending, substantially parallel wall portions disposed along opposite longitudinal edges thereof wherein a lower portion of the roof truss or joist fits within what may be considered a cradle defined by the central web and upstanding wall portions. Two spaced apart elongated anchor straps are adjustably attached to opposite ones of the wall portions and are adapted to be secured by nails or like connectors to opposite sides of the top portion of the roof truss and further wherein each anchor strap includes a lower length disposed and adapted to be embedded in wet concrete initially defining the tie beam of the building on which the channel length and truss rests.

16 Claims, 2 Drawing Sheets

SEAT AND ANCHOR ASSEMBLY FOR A ROOF TRUSS AND WOODEN JOIST

BACKGROUND OF THE INVENTION

In the past, it has been known to provide a truss seat and anchor assembly wherein a channel is provided with an anchor strap riveted to one of two opposite channel walls. In use, such an assembly is provided to cradle the end zone of a roof truss or wood joist on a concrete tie beam forming an upper wall portion of a building. The web of the channel serves as a barrier to keep the wood of the truss or joist out of contact with the upper surface of the concrete protecting it from moisture. In use, a lower end of the anchor strap is embedded in the concrete of the tie beam when wet and an upper end is bent over the roof truss or wood joist so that headed nails can be passed through the anchor strap on opposite sides of the roof truss or wood joist. In the past, the anchor straps were secured to the channels in order to maintain the assembly conveniently together until installed. Usually, the straps were secured to the channel by means of a rivet. The rivet serves no function in the use of the assembly but is for the purpose of securing the strap and the channel together prior to use.

In a hurricane, it has been found that there is often a failure of the zone of connection of the roof truss and/or truss seat and anchor assembly. This is primarily due to the generally upwardly directed forces causing the roof to fly upwardly away from the tie beam as opposed to the generally downwardly directed forces as is characteristic in an earthquake.

As in the present invention, it has been determined that two anchor straps riveted or otherwise adjustably connected in spaced longitudinal relation to one another with respect to the central web portion of the channel length will provide increased resistance to upwardly directed forces by hurricane strength winds. Further, it has been determined that longitudinally spacing of the straps along the length of the channel will resist wood fracture but nevertheless increase the strength of resistance to such wind forces.

SUMMARY OF THE INVENTION

This invention is of a truss seat and anchor assembly comprising a channel length with a central web portion and upstanding spaced and substantially parallel side walls to cradle a truss and wherein two anchor straps are provided which are riveted or otherwise adjustably connected to the wall portion in longitudinally spaced relation to one another. One anchor strap is connected to one of the wall portions of the channel length and the other anchor strap is spaced longitudinally from the first anchor strap and is connected to the other of the wall portions.

The assembly can easily be transported to a job site for use in anchoring the trusses in spanning relation to walls each having an upper peripheral tie beam. At a job site, since there are often numerous workmen at a given time, if there are not enough anchor straps or alternatively, not enough channel lengths, the job is shut down and a run must be made to secure an additional supply of channel lengths or anchor straps. This invention is of an assembly wherein the two anchor straps are pre-attached to the channel by rivets or other adjustable means at spaced predetermined positions along the length of the web portion of the channel. Such attachments are provided so that delays and job shut downs are avoided as set forth above. Also, such attachments of the anchor straps to the wall portion provide predetermined spacing of the anchor straps to assure additional resistance to upward forces without fear of fracture of the wood material of the truss when nails are applied thereto.

Another feature of the present invention is the adjustable attachment of each of the anchor straps to the opposite wall portions preferably by rivet-type connector means. Such adjustable attachment is accomplished through the provision of an elongated slot formed in each of the anchor straps at the point of juncture of the anchor straps to the wall portions. A rivet-type connector is secured in substantially perpendicular relation to each of the wall portions and passes through the elongated slot. This allows longitudinal movement or adjustment of the anchor straps relative to both their placement in the wet cement of the tie beam, prior to its setting and also longitudinal adjustment relative to the truss members once they are placed on the cradle defined by the central web portion and upstanding spaced apart wall portions.

Other type of connector means may be utilized other than the aforementioned rivet connector. Such different embodiments include a finger spaced outwardly from at least one or both of the wall portions so as to form an elongated passage between the inner surface of the finger and the outer surface of the wall portion to which it is attached. This passage is adapted to adjustably and removably receive one of the anchor straps therein such that the anchor straps move relative to the wall portion to which it is attached within this passage along its own longitudinal dimension. Similarly, yet another embodiment of a connector means may include an elongated slot formed in the wall portion so as to form an elongate passage, adapted to adjustably receive one of the anchor straps therein. Similarly, yet another embodiment of a connector means may include an L-shaped finger having one open end and spaced outwardly from a wall portion to which it is attached such that an elongated segment of this L-shaped finger is substantially parallel to the wall portion. A passage is defined between the elongated segment and the wall portion for purposes of movably and adjustably retaining an anchor strap therein.

BRIEF DESCRIPTION OF THE DRAWINGS

For a fuller understanding of the nature of the present invention, reference should be had to the following detailed description taken in connection with the accompanying drawings in which.

Like reference numerals refer to like parts throughout the several views of the drawings.

DETAILED DESCRIPTION OF THE PREFERRED EMBODIMENT

Figure 1:
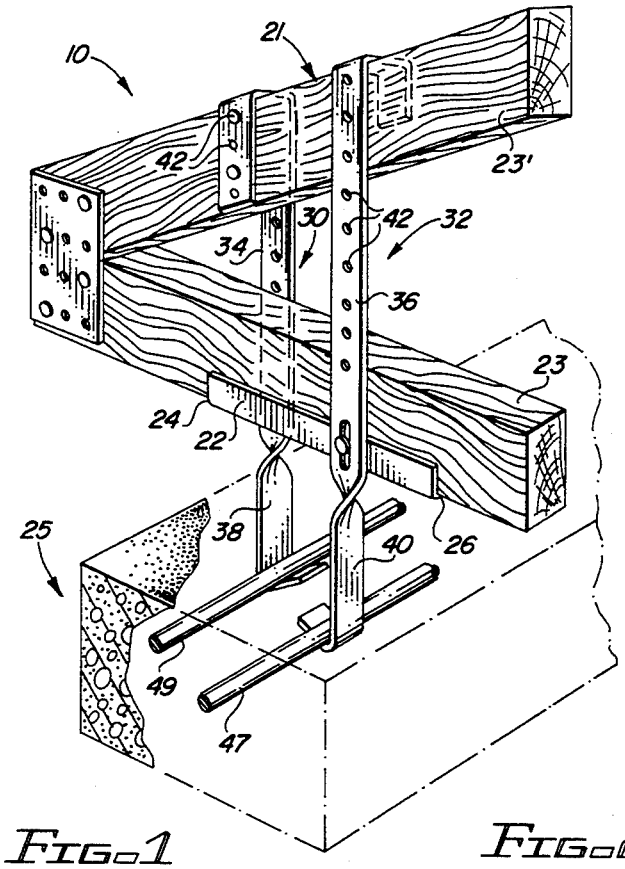
FIG. 1 is a perspective view and partial cutaway showing the subject assembly of the present invention attached to a roof truss and embedded in a tie beam.

As shown in the accompanying figures, the subject seat and anchor assembly is generally indicated as 10 and comprises an elongated channel portion generally indicated as 12. The channel portion 12 is defined by a central, substantially flat web 14 extending along the length of the channel 12. The web includes two oppositely disposed, substantially parallel longitudinal edges as at 16 and 18. Each of these edges includes a wall portion 20 and 22 secured thereto and extending upwardly from the central web portion 14 in substantially parallel and spaced apart relation to one another.

Figure 2:
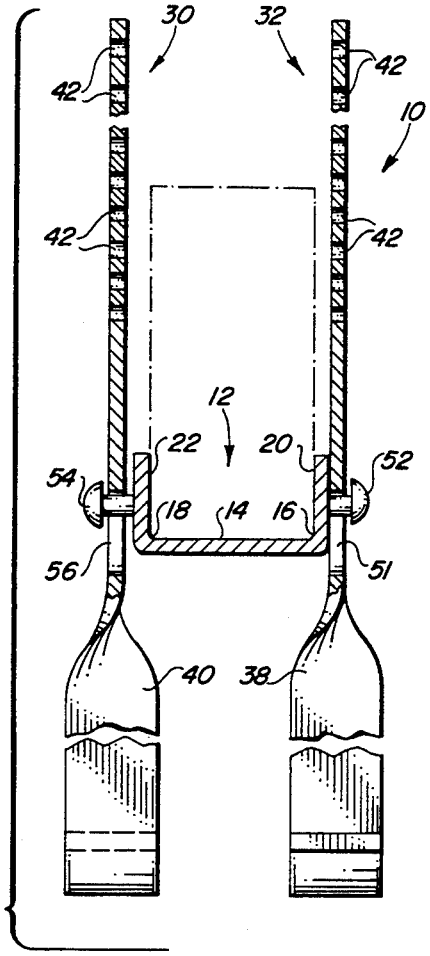
FIG. 2 is a longitudinal sectional view in partial cutaway showing details of the embodiment of FIG. 1.

As best shown in FIG. 2, the combined central web portion 14 and the upstanding wall portions 20 and 22 define a truss cradle in which a lower portion 23 of the truss generally indicated as 21 may rest. To facilitate placement of the roof truss 21 in the position shown in FIG. 2, the opposite ends as at 24 and 26 of the resulting truss cradle are open. As best pictured in FIG. 1, the purpose of the seat and anchor assembly 10 is for purposes of adequately positioning and securing the roof truss 21 in anchored, secured relation to a tie beam generally indicated as 25. The tie beam 25 is formed of cement and as explained in greater detail hereinafter, anchor straps associated with the subject assembly 10 are embedded within the tie beam 25 while the cement from which it is formed is still wet and penetratable.

The aforementioned anchor means associated with the subject assembly includes two spaced apart anchor straps 30 and 32 having an upper length as at 34 and 36 and a lower length as at 38 and 40. Each of the elongated straps 30 and 32 are formed from a bendable material, preferably metal, so that both the upper and lower lengths may bend and be connected to the roof truss 21 and the tie beam 25 respectively. More specifically, each of the upper lengths 34 and 36 of the respective anchor straps include a plurality of spaced apart apertures as at 42 wherein the apertures 42 extend along the length of the upper lengths 34 and 36 in spaced relation to one another. The size of the apertures 42 are such as to allow passage therethrough of the shaft portion of a headed nail or like connector wherein such nails are then embedded in the upper portion 23' of roof truss 21 or like wood joist.

Again, as shown in FIG. 1, the lower lengths 38 and 40 are embedded within the wet concrete of the tie beam 25 prior to its setting so as to securely anchor the anchor straps and thereby the entire seat and anchor assembly 10 on the tie beam 25 so as to secure a wood joist or as shown, a roof truss 21 thereto. As also shown in FIGS. 1 and 2, the lower lengths 38 and 40, which may be twisted, as shown, or not twisted and straight, may then be bent about or otherwise attached to re-bar members 47 and/or 49 or alternatively may merely just be embedded within the concrete of the tie beam 25 prior to its setting without specific twisting or bent attachment to the re-bar 47 and 49. Another feature of the present invention is the attachment of each of the anchor members 30 and 32 to different wall portions 20 and 22 substantially adjacent opposite ends thereof. In one embodiment, this is accomplished by rivet members defining a connecting means and indicated as at 52 and 54 (see FIGS. 2 and 3) passing through elongated slots 56 and 58 formed in each of the anchor straps 32 and 30 at the juncture of the anchor straps 30 and 32 and the respective wall portions 20 and 22. The rivet members 52 and 54, defining the connecting means for the anchor straps extend outwardly, substantially perpendicular to the wall portions 20 and 22 and through the elongated apertures 58 and 56. Such placement and cooperative connection allows adjustable positioning of each of the anchor straps along their length due to the fact that the elongated slots 56 and 58 allow adjustable movement of the straps along their lengths relative to both the respective rivets 54 and 52 and the wall portions 20 and 22.

Figure 4:
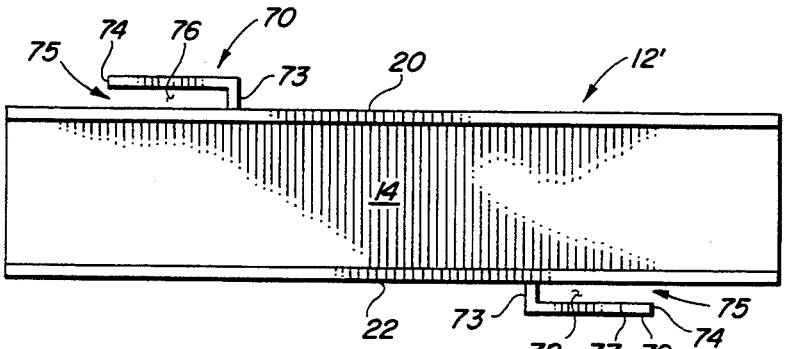
FIG. 4 is a top view of yet another embodiment of a connector structure for adjustably securing anchor straps to a central web portion of the subject truss seat assembly.
Figure 5:
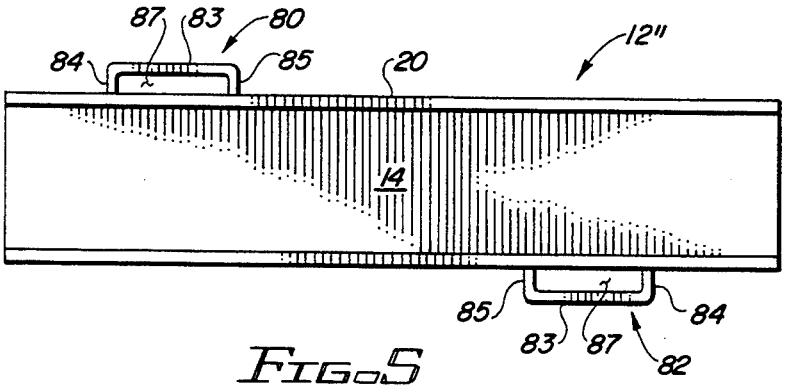
FIG. 5 is a top view of yet another embodiment of a connector structure for securing the anchor straps to the central web of the subject truss seat assembly.
Figure 6:
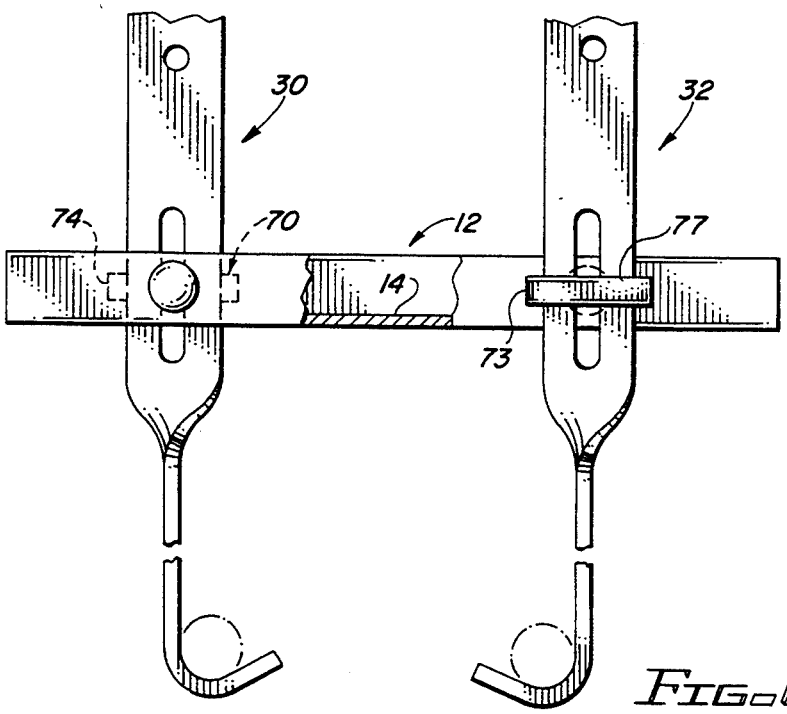

With regard to the embodiments of FIGS. 4 and 5, different connector means are shown which movably or adjustably attach various anchor straps (not shown) to the central web 14 and more particularly to the side wall portions 20 and 22. In the embodiment of FIG. 4, the connector means comprises L-shaped fingers generally indicated as 70 and 72 wherein an innermost end as at 73 of each of these fingers is fixedly or otherwise integrally attached to the respective wall portions 20 and 22. The outermost end as at 74 may be free thereby defining an opening generally indicated as 75 which leads into an anchor strap retaining passage 76. The passages 76 of each of the L-shaped fingers 70 and 72 are more particularly defined by the outer spaced apart and parallel relation of the elongated primary segment 77 of each of the fingers 70 and 72. The passage 76 of each of the L-shaped fingers 70 and 72 is adapted to allow retaining and adjustable or movable connection of opposite ones of the anchor straps 32 and 34 therein such that these straps may be generally adjusted or movable along their length relative to the respective wall portions 20 and 22 and of course the central web 14.

With regard to FIG. 5, the first and second connector means are indicated as 80 and 82 respectively on the elongated channel portion 12''. The central web is of course flanked by two upstanding wall portions 20 and 22 as in the previous embodiments. The first and second connector means 80 and 82 as generally indicated include an elongated finger 83 having each of its opposite ends as at 84 and 85 fixedly or integrally attached to the respective wall portions 20 and 22 as shown. A passage as at 87 is formed between the inner surfaces of each of the fingers 83 and the outer surfaces of the respective wall portions as at 20 and 22. Again, these passages 87 are structured, dimensioned, and thereby specifically adapted to adjustably and movably receive a different anchor strap therein such that such anchor straps may be adjustably positioned along their length relative to the central web 14.

Figure 3:
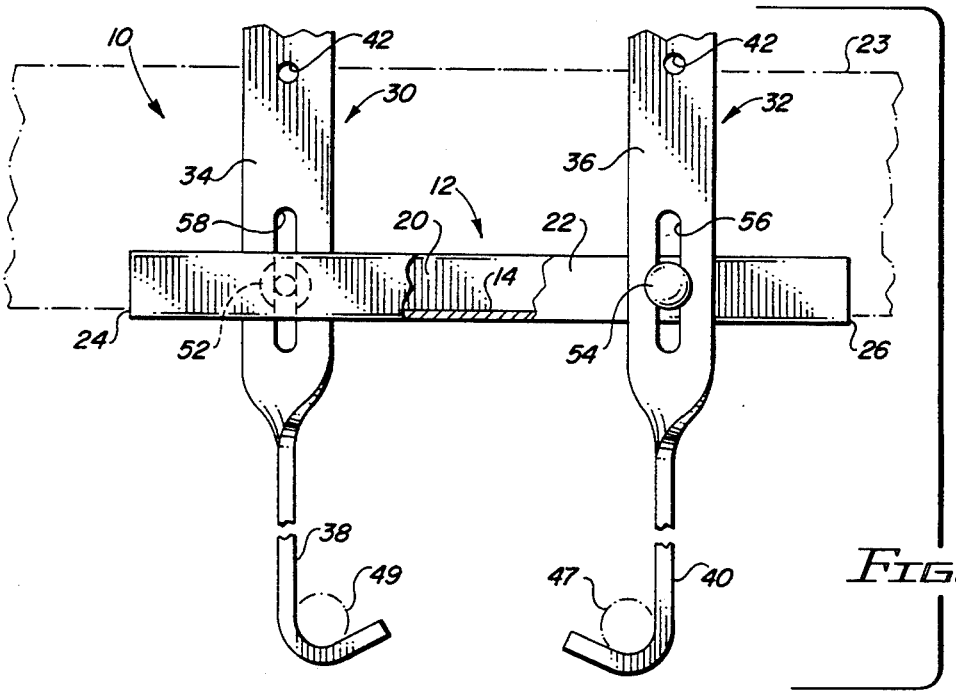
FIG. 3 is a side view and partial cutaway showing additional details of the embodiment of FIGS. 1 and 2.

Other additional embodiments may include a combination of the connector means of the type shown in FIGS. 3, 4 and 5. For example, a first connector means may include a rivet-type structure of the embodiment of FIG. 3 wherein a second connector means on a same central web 14 may include either an L-shaped finger 70 or 72 or an elongated fixed finger 80 and 82. Also, the L-shaped fingers 70 or 72 may be combined in the same fashion but on opposite sides of course with the fixed fingers 80 and 82.

As set forth above, the operative, fixed position of the anchor straps 30 and 32 relative to the remainder of the assembly 10 and specifically to the truss 21 and tie beam 25 shows that the upper lengths 34 and 36 extend above the web 14 of the channel 12 and into fixed engagement on opposite sides of the truss member 21 as they are nailed to the upper members of the truss as at 23'. This operative position is further defined by the lower lengths 38 and 40 of the anchor straps extending in embedded relation into the interior of the tie beam 25 when the cement forming the tie beam is still uncured.

Now that the invention has been described,

What is claimed is:

1. An improved truss seat and anchor strap assembly comprising:

a) a channel length having a first and a second end, a central web portion with longitudinally extending parallel edges having a first and a second wall portion secured thereto, each wall portion extending longitudinally along one of said edges in generally parallel relation to one another and extending upwardly from said central web portion to define a truss cradle therebetween, said truss cradle adapted to receive a truss on the central web portion and between said wall portions, b) a first and a second elongate anchor strap of bendable metal, each anchor strap having an upper, generally flat length with spaced nail holes extending therealong and a lower length adapted to be embedded in wet concrete, c) first connector means for adjustably connecting said first anchor strap to said channel length and extending outwardly in generally perpendicular relation to the first wall portion and extending through said first wall portion and movably engaging said first anchor strap, and second connector means for adjustably connecting said second anchor strap to said channel length and extending outwardly in generally perpendicular relation to said second wall portion and movably engaging said second anchor strap, d) said first and second anchor straps being attached to said first and second wall portions respectively of said channel length in spaced relation to one another along the length of said central web portion and substantially adjacent the opposite ends of said first and second wall portions, and e) said upper length of each of said first and second anchor straps extending above said channel and said lower length of said first and second anchor straps extending below said channel, wherein said first and second anchor straps are in an operative position.

2. The assembly as set forth in claim 1 wherein the lower length of each of said first and second anchor straps includes a terminal end zone and the terminal zone of each of said first and second anchor straps is bent out of the plane of the upper length of a respective anchor strap when said first and second anchor straps are in said operative position.

3. The assembly as set forth in claim 1 wherein the wall portions are spaced from one another a distance to accommodate receipt of the narrow width of a 2×4.

4. The assembly as set forth in claim 1 wherein the wall portions are spaced from one another a distance to accommodate receipt of the narrow width of a 3×3.

5. The assembly as set forth in claim 1 wherein the wall portions are spaced from one another a distance to accommodate receipt of the narrow width of a 4×4.

6. The assembly as set forth in claim 1 wherein said central web portion is disposed beneath and in supporting relation to a truss and in supported engagement on a tie beam.

7. The assembly as set forth in claim 6 wherein the tie beam is initially defined by the wet concrete in which the lower length of each of said first and second anchor straps are embedded.

8. The assembly as set forth in claim 1 wherein each of said first and second anchor straps include an elongate adjustment slot formed therein at a juncture of each anchor strap and a respective wall portion to which it is adjustably attached.

9. The assembly as set forth in claim 8 wherein each of said first and second connector means extends through respective wall portions and through said elongate adjustment slots in said first and second anchor straps.

10. The assembly as set forth in claim 9 wherein each of said first and second connector means comprises a rivet member extending through said respective ones of said elongate adjustment slots and outwardly from and in perpendicular relation to respective ones of said first and second wall portions, said first and second straps being adjustably movable along their lengths relative to respective ones of said rivet members and wall portions.

11. The assembly as set forth in claim 1 wherein at least one of said first and second connector means comprises an elongated finger extending outwardly from and in spaced relation to one of said first and second wall portions to define an elongated passage between said finger and a corresponding wall portion to which it is attached, said passage adapted to movably receive one of said first and second anchor straps therein.

12. The assembly as set forth in claim 11 wherein spaced apart opposite ends of said elongated finger are fixedly attached to a corresponding wall portion and said opposite ends of said finger defines the length of said passage.

13. The assembly as set forth in claim 12 wherein the other of said first and second connector means comprises a rivet member extending through one of said elongated adjustment slots of one of said anchor straps and outwardly from and in perpendicular relation to one of said wall portions, said first and second anchor straps being adjustably movable along their lengths relative to respective ones of said rivet member and said elongated finger.

14. The assembly as set forth in claim 1 wherein at least one of said first and second connector means comprises an L-shaped finger having an inner end fixedly secured to one of said wall portions and a free outer end spaced from a corresponding wall portion, said L-shaped finger including a main segment spaced in substantially parallel relation to a corresponding wall portion to define an anchor retaining space therebetween.

15. The assembly as set forth in claim 14 wherein the other of said first and second connector means comprises a rivet member extending through one of said elongated adjustment slots of one of said anchor straps and outwardly from and in perpendicular relation to one of said first and second wall portions, said first and second straps being adjustably movable along their lengths relative to respective ones of said rivet member and said L-shaped finger.

16. The assembly as set forth in claim 14 wherein at least one of said first and second connector means comprises an elongated finger extending outwardly from and in spaced relation to one of said first and second wall portions to define an elongated passage between said finger and a corresponding wall portion to which it is attached, said passage adapted to movably receive one of said first and second anchor straps therein.

* * * * *